US006896067B2

(12) United States Patent
Bowyer et al.

(10) Patent No.: US 6,896,067 B2
(45) Date of Patent: May 24, 2005

(54) METHOD AND APPARATUS FOR DISTRIBUTING FIRE SUPPRESSANT

(76) Inventors: James Bowyer, 70 Fayette St., Watertown, MA (US) 02472; Robert Dunster, 34, Royston Way, Slough, Burnham (GB), SL1 6ER; David S. Rausch, 26 Larson Ave., Leominster, MA (US) 01453; William Mahony, 39 Willow Rd., Sudbury, MA (US) 01776

( * ) Notice: Subject to any disclaimer, the term of this patent is extended or adjusted under 35 U.S.C. 154(b) by 61 days.

(21) Appl. No.: 10/253,297

(22) Filed: Sep. 23, 2002

(65) Prior Publication Data

US 2004/0055764 A1 Mar. 25, 2004

(51) Int. Cl.[7] ..... A62C 2/00
(52) U.S. Cl. ..... 169/46; 137/625.46
(58) Field of Search ..... 169/46, 19, 5, 169/9, 16; 137/625.46; 239/304, 305, 550, 551, 569, 16, 20, 9, 43, 46, 60, 61, 71, 72, 85

(56) References Cited

U.S. PATENT DOCUMENTS

| | | | | |
|---|---|---|---|---|
| 4,082,148 A | | 4/1978 | Willms | |
| 4,305,469 A | | 12/1981 | Morrisette | |
| 4,520,871 A | | 6/1985 | Miller et al. | |
| 5,273,073 A | * | 12/1993 | Romanchik et al. | 137/625.47 |
| 5,673,755 A | | 10/1997 | Sundholm | |
| 5,676,210 A | | 10/1997 | Sundholm | |
| 5,988,220 A | * | 11/1999 | Sakaki | 137/625.47 |
| 6,135,153 A | * | 10/2000 | Cleland et al. | 137/625.46 |
| 6,647,934 B2 | * | 11/2003 | Marsh et al. | 123/41.33 |
| 6,672,336 B2 | * | 1/2004 | Nichols | 137/625.46 |

FOREIGN PATENT DOCUMENTS

EP 0 409 237 A2 1/1991

* cited by examiner

*Primary Examiner*—David A. Scherbel
*Assistant Examiner*—Thach H. Bui
(74) *Attorney, Agent, or Firm*—Merchant & Gould P.C.

(57) ABSTRACT

A fire suppressing system having at least one suppressant source, at least two control valves in communication with the suppressant source, and at least two distributors, each distributor being in communication with one of the control valves. The control valves are movable between at least three of first, second, third, and fourth positions. Functionally, in the first position, each of the control valves passes suppressant therethrough, but does not pass suppressant to its distributor. In the second position, each of the control valves does not pass suppressant therethrough, but passes suppressant to its distributor. In the third position, each of the control valves passes suppressant therethrough, and passes suppressant to its distributor. In the fourth position, each of the control valves does not pass suppressant therethrough and does not pass suppressant to its distributor. Depending upon the positions of the control valves, the suppressing system directs suppressant from the suppressant source to any one or more of the distributors.

20 Claims, 8 Drawing Sheets

B

C

D

E

F

METHOD AND APPARATUS FOR DISTRIBUTING FIRE SUPPRESSANT

BACKGROUND OF THE INVENTION

1. Field of the Invention

The invention relates to an apparatus and method for distributing fire suppressant.

The invention relates more particularly to an apparatus and method for delivering a fire suppressant selected from among one or more available suppressants to any combination of one or more suppressant distributors.

2. Description of Related Art

A variety of materials are known that can suppress fires. In general, these fire suppressants must be distributed in the immediate vicinity of the fire in order to be effective. Several conventional approaches for distributing fire suppressants are known.

First, a single suppressant source may be connected to a single control valve, which is then connected to a distributor that is in the area where suppressant is to be distributed. In response to a fire, the control valve is opened, whereupon suppressant flows from the suppressant source to the distributor, and thus to the fire.

This arrangement, while simple, has a number of disadvantages, one of the more serious being that it a requires a dedicated system for each location, i.e. a source of suppressant must be provided for each area that is to be protected. This is often impractical or undesirable.

It is also known to connect one or more fire suppressant sources with a series of control valves, each control valve being connected with a distributor. Such an arrangement is illustrated in FIGS. 1 and 2.

In the arrangement illustrated, the system 10 includes four suppressant sources 20, 22, 24, and 26. The suppressant sources are all in communication (i.e. via a line, pipe, or tube) with a series of control valves 30, 32, 34, 36, and 38. Each of the control valves connects to a suppressant distributor 40, 42, 44, 46, and 48 (not shown). The arrangement of control valves and connecting lines is sometimes referred to collectively as a discharge manifold.

Each of the control valves in this conventional arrangement defines two apertures therein: 30A and 30B; 32A and 32B; 34A and 34B; 36A and 36B; and 38A and 38B. Each control valve is movable between two positions, closed and open. In the closed position, the two apertures of the control valves are not in communication with one another. In the open position, the two apertures are in communication. Consequently, for the configuration shown, in the closed position the control valves 30, 32, 34, 36, and 38 do not pass suppressant, while in the open position, they do.

FIG. 1 shows all of the control valves 30, 32, 34, 36, and 38 in their closed positions, as might be typical when the system is inactive. FIG. 2 shows control valve 38 in the open position. Given the positions of the control valves in FIG. 2, apertures 38A and 38B are in communication, thus suppressant from one or more of the sources 20, 22, 24, and 26 (depending on which was open) would pass through control valve 38 to distributor 48.

In such an arrangement, multiple distributors in multiple locations can be supplied by a single set of suppressant sources. However, this arrangement also has disadvantages.

For example, when any one of the control valves 30, 32, 34, 36, and 38 is opened, a large part of the manifold that is not utilized for suppressant distribution at that time nevertheless is filled with suppressant. In FIG. 2, suppressant would flow all the way to control valve 30. The portion of the system that is filled, but does not need to be filled, is sometimes referred to as "dead space". Such an arrangement is undesirable for several reasons.

For example, dead space diverts suppressant from the location where it is actually needed. In order for a fire suppressant distribution system to be effective, it is important that the quantity of suppressant that is discharged from each distributor be predictable to within established tolerances of the desired discharge quantity and discharge time. In a conventional system as shown in FIGS. 1 and 2, portions of the manifold may be unnecessarily filled with suppressant. Although in some cases the dead space in a system may be vented or discharged, in some cases the agent will not immediately discharge within a proscribed time period (i.e. 10 seconds). This affects the operation of the system; the effects must either be ignored and accepted, or compensated for in other ways.

In cases where the amount of dead space is large (i.e. in a large manifold, with long lines between the suppressant sources 20, 22, 24, and 26 and the most distant of the control valves 30, 32, 34, 36, and 38), this may substantially increase the amount of suppressant that must be used when the system is activated. Similarly, the volume of the dead space may be large enough to require an increased pressure at the sources 20, 22, 24, and 26 when activating the system, so as to maintain adequate distribution pressure at the open distributor 38.

Furthermore, after each activation of such a system, it may be necessary to clean and/or service the entire manifold from the suppressant sources 20, 22, 24, and 26 to the most distant of the control valves 30, 32, 34, 36, and 38, regardless of which of the control valves was opened.

There exists a need for a system that enables distribution of suppressant to any of several available distributors, without unnecessarily filling large unused portions of the system during each activation.

SUMMARY OF THE INVENTION

It is the purpose of the claimed invention to overcome these difficulties, thereby providing an improved apparatus and method for distributing fire suppressant.

An exemplary embodiment of an apparatus in accordance with the principles of the claimed invention includes at least one suppressant source, at least one control valve in communication with the suppressant source, and at least one distributor, each distributor being in communication with at least one control valve.

The control valves each define first, second, and third apertures therein. The control valves are each movable between first, second, and third positions.

In the first position, the first and third apertures of each valve are in communication with one another.

In the second position, the second and third apertures of each valve are in communication with one another.

In the third position, the first, second, and third apertures of each valve are in communication with one another.

In addition, in certain embodiments the control valves may be movable to a fourth position, as well. In the fourth position, the first and second apertures of each valve are in communication with one another.

This feature enables not only discharge of suppressant through each control valve, but also direction of suppressant both through each control valve, without actually discharging through a distributor connected thereto. As a result, it is possible to discharge suppressant from any one or more of the distributors, in any combination.

For example, in the exemplary embodiment illustrated in FIG. 3, in the first position, each of the control valves passes suppressant therethrough, but does not pass suppressant to its distributor.

In the second position, each of the control valves does not pass suppressant therethrough, but passes suppressant to its distributor.

In the third position, each of the control valves passes suppressant therethrough, and passes suppressant to its distributor.

Thus, depending upon the positions of the control valves, a suppressing system in accordance with the principles of the claimed invention may be made to direct suppressant from the suppressant source (or from any one of several suppressant sources) to any combination of the distributors.

As noted above, in certain embodiments the control valves may be movable to a fourth position, as well. In the arrangement of FIG. 3, in the fourth position each of the control valves does not pass suppressant therethrough, and does not pass suppressant to its distributor.

One possible valve that is suitable for use as a control valve in the claimed invention is a so-called "T control valve", such as a three-way through T directional ball valve. However, this is exemplary only, and other valves may be equally suitable.

BRIEF DESCRIPTION OF THE DRAWINGS

Like reference numbers generally indicate corresponding elements in the figures.

FIGS. 4A–F illustrate a schematic representation of control valves in the embodiment of FIG. 3, shown in various positions.

DETAILED DESCRIPTION OF THE PREFERRED EMBODIMENT

Figure 3:
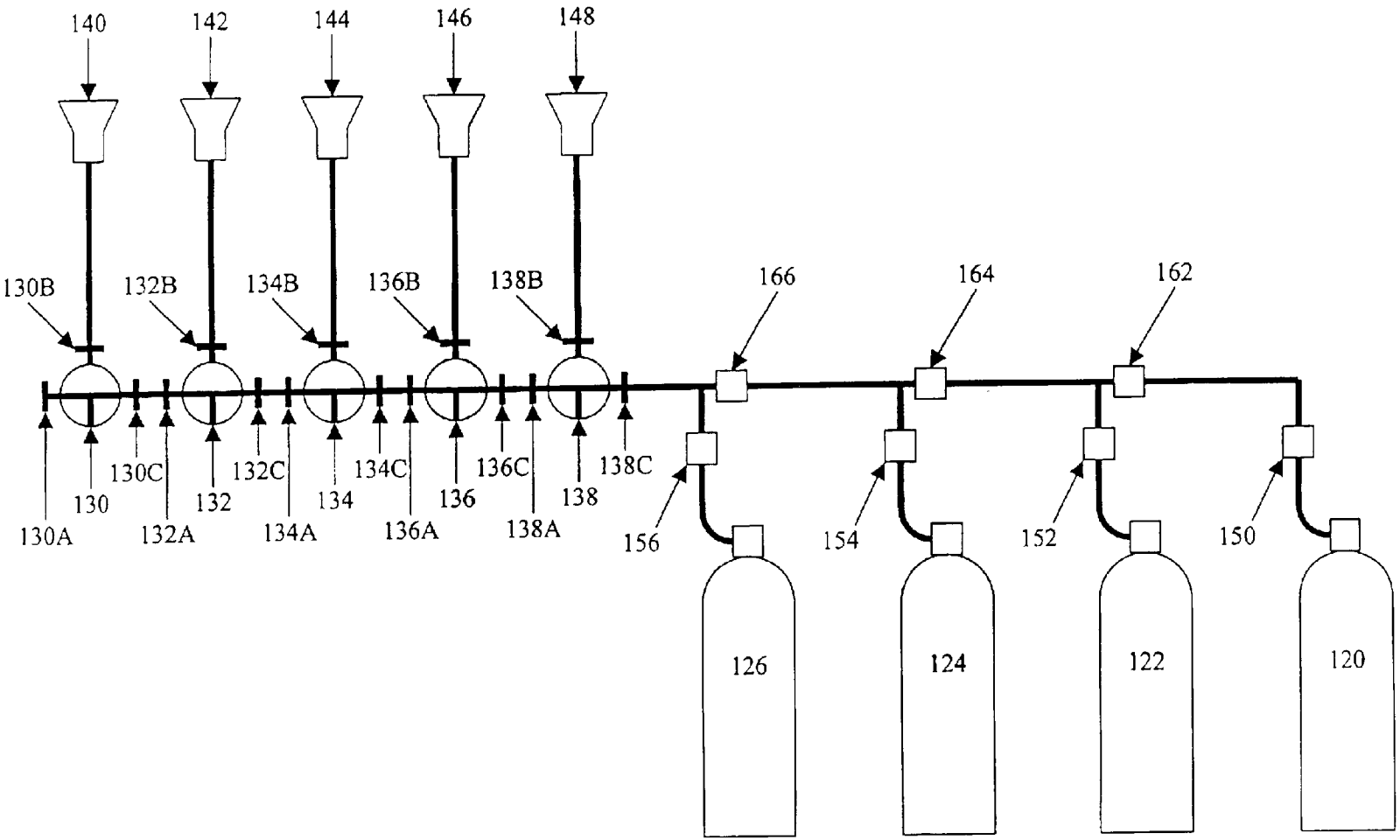
FIG. 3 is a schematic representation of an exemplary embodiment of a suppressant distribution system in accordance with the principles of the claimed invention.

Referring to FIG. 3, an apparatus 110 for fire suppression in accordance with the principles of the claimed invention includes at least one fire suppressant source. As shown in FIGS. 3 and 5–7, the apparatus has four fire suppressant sources 120, 122, 124, and 126. However, this is exemplary only.

A variety of suppressant sources may be suitable. As shown in FIG. 3, the sources 120, 122, 124, and 126 may be single tanks, such as might be used for a superpressurized agent system.

Figure 5:
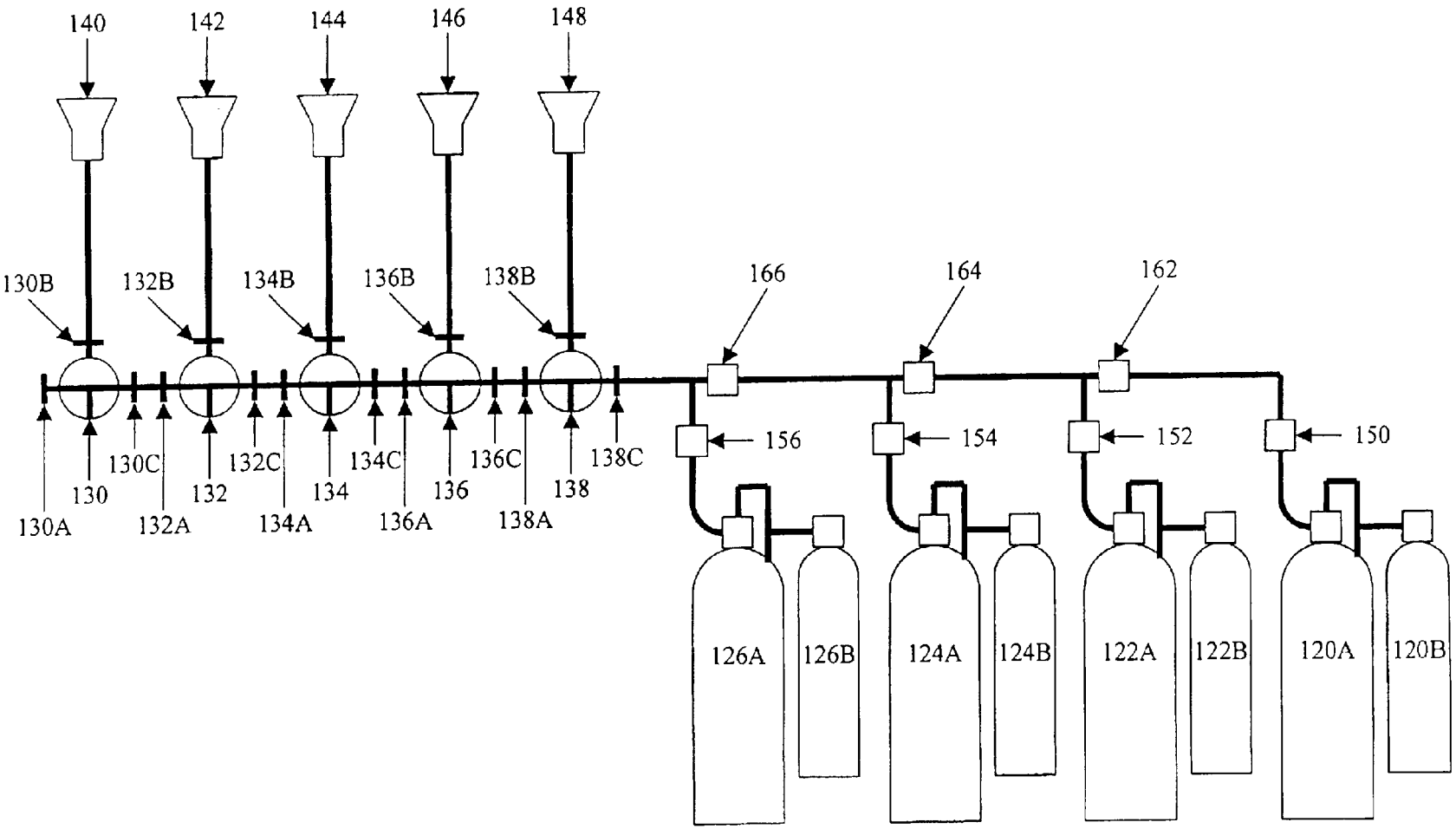
FIG. 5 is a schematic representation of another exemplary embodiment of a suppressant distribution system in accordance with the principles of the claimed invention, having double tank suppressant sources.

However, this is exemplary only. As shown in FIG. 5, the sources 120, 122, 124, and 126 may be double tanks, such as might be used with a piston-flow system. In the arrangement shown in FIG. 5, tanks 120A, 122A, 124A, and 126A contain the suppressant proper, while tanks 120B, 122B, 124B, and 126B contain a pressurizing fluid, such as compressed nitrogen.

In addition, other arrangements than those illustrated may be equally suitable. Suppressant sources are well known, and are not further described herein.

It is noted that a wide variety of suppressants may be suitable for use with a system in accordance with the principles of the claimed invention. Suitable suppressants include, but are not limited to, gasses, liquids, granular solids, and foams.

More particularly, suitable fire suppressants include, but are not limited to, liquefied compressed gas chemical extinguishing agents, such as HFC-227ea, HFC-23, $CO_2$, and $CF_3CF_2C(O)CF(CF_3)_2$. However, it is emphasized that the specific suppressants identified herein are exemplary only. Suppressants other than those named may be equally suitable. Furthermore, it is emphasized that the use of liquefied compressed gas chemical extinguishing agents is itself exemplary, and that fire suppressants other than liquefied compressed gas chemical extinguishing agents may be equally suitable.

Each suppressant source may supply a different suppressant. Alternatively, some or all of the suppressant sources may supply identical suppressants.

Fire suppressants are well known, and are not described further herein.

It is also noted that with regard to the claimed invention, the term "fire suppression" is used broadly. Firstly, "fire" encompasses both slow-burning conventional fires and explosions. Furthermore, "suppression" encompasses not only actions to extinguish or diminish a fire or explosion once it begins, but also actions to counteract a fire or explosion that is immanent, as well as to prevent fires and explosions under conditions wherein their formation is likely but not certain. For example, for certain embodiments of the claimed invention fire suppression may include the distribution of fire suppressant to a location wherein a combustible gas is detected, even if no fire or explosion has yet occurred. This preemptive action is sometimes referred to as "inerting", as it is done to render an area inert with respect to fire and explosion.

The suppressant sources 120, 122, 124, and 126 are in communication with at least one control valve. In the embodiments illustrated in FIGS. 3 and 5–7, there are a total of five control valves 130, 132, 134, 136, and 138. However, this is exemplary only.

Each of the control valves defines first, second, and third apertures therein: 130A, 130B, and 130C; 132A, 132B, and 132C; 134A, 134B, and 134C; 136A, 136B, and 136C; and 138A, 138B, and 138C. Each of the control valves 130, 132, 134, 136, and 138 is movable between at least three of first, second, third, and fourth positions.

In the first position, the first and third apertures of each valve are in communication with one another.

In the second position, the second and third apertures of each valve are in communication with one another.

In the third position, the first, second, and third apertures of each valve are in communication with one another.

In the fourth position, the first and second apertures of each valve are in communication with one another.

In certain embodiments the control valves may be movable to all four of these positions.

In embodiments with control valves that are not movable to all four positions, which three of the four above positions the control valves are movable may vary based on the particulars of the embodiments in question, and the arrangement of the control valves therein. Generally, the three positions are determined by the specific desired function of each individual control valve, i.e. in what direction(s) suppressant is to be passed by the control valve in question.

Not all control valves in a given embodiment will necessarily be movable to the same three positions. Likewise, not all control valves will pass suppressant in the same direction(s).

As an alternative to a specific description of which apertures are in communication in a given position, the control valves may be described based on their functionality, i.e. in what directions suppressant is passed.

In the exemplary arrangement shown in FIG. 3, in the first position, each control valve passes suppressant therethrough (i.e., to the next control valve "downstream"), but does not pass suppressant to a distributor (see below) in communication with the control valve.

In the second position, each control valve does not pass suppressant therethrough, but passes suppressant to a distributor in communication therewith.

In the third position, each control valve passes suppressant therethrough, and passes suppressant to a distributor in communication with the control valve.

In embodiments wherein the valve is movable to a fourth position, in the fourth position, each control valve does not pass suppressant therethrough, and does not pass suppressant to a distributor in communication with the control valve.

It is emphasized that the particular arrangement of control valves that produces the above-identified functional results is exemplary only. The control valves may be arranged otherwise, so that different positions may result in different distributions of suppressant.

Figure 6:
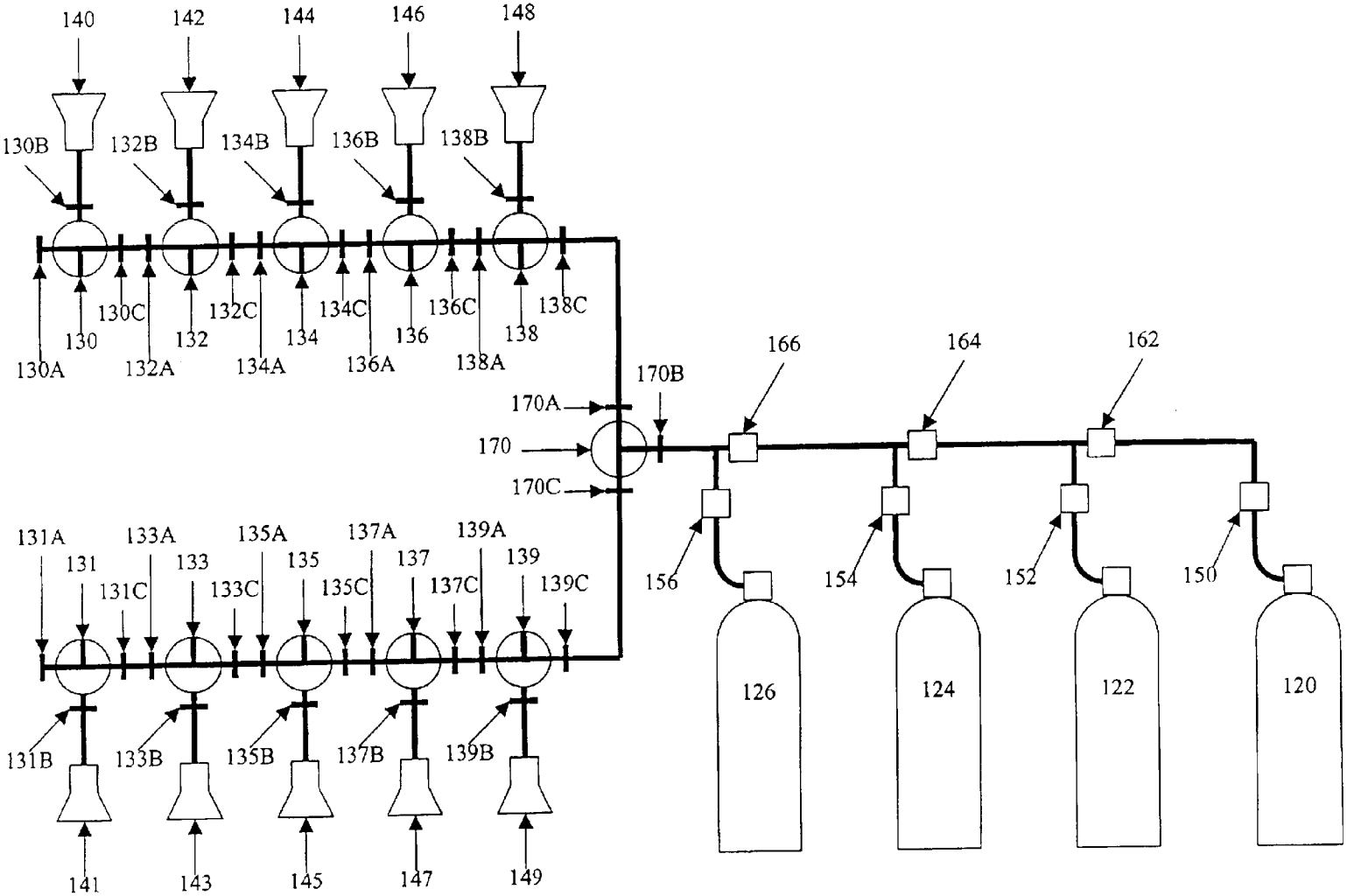
FIG. 6 is a schematic representation of still another exemplary embodiment of a suppressant distribution system in accordance with the principles of the claimed invention, having multiple discharge lines.

As shown in FIGS. 3, 5, and 6, all of the control valves 130, 132, 134, 136, and 138 are in the first position. For certain embodiments, this may be considered a neutral or standby position. Thus, the control valves may remain in this position when not otherwise specifically moved to other positions. However, this is exemplary only.

Control valve position and the results thereof is discussed further below.

Each control valve 130, 132, 134, 136, and 138 is in communication with at least one distributor 140, 142, 144, 146, and 148. More particularly, one of the apertures of each control valve is in communication with the distributors. As illustrated, the second apertures 130B, 132B, 134B, 136B, and 138B are in communication with distributors 140, 142, 144, 146, and 148. However, this is exemplary only, and other arrangements may be equally suitable.

Furthermore, although as illustrated, each control valve 130, 132, 134, 136, and 138 is in communication with exactly one distributor, 140, 142, 144, 146, and 148, in certain embodiments a control valve may be in communication with multiple distributors.

A variety of distributors may be suitable for use with the claimed invention. The precise structure and arrangement of the distributors will depend on both the type of suppressant that is used, and the type of fire (i.e. anticipated location, size, fuel type, etc.) that is to be suppressed. Suitable distributors include, but are not limited to, gas discharge vents, liquid atomizers, foam sprayers, and granular distribution heads.

Each of the elements of the system are brought into communication by some form of line or connector, as illustrated in FIGS. 3 and 5. Suitable connectors include, but are not limited to, rigid pipe, flexible hose, tubing, and conduits. Not all connectors need be the same. For example, some of the connectors in a particular embodiment may be flexible hose, while others are rigid pipe.

Connectors are well known, and are not described further herein.

In addition to the control valves 130, 132, 134, 136, and 138, some embodiments in accordance with the principles of the claimed invention may include additional valves, which may be connected differently from control valves 130, 132, 134, 136, and 138, and which may also function differently.

For example, as shown in FIGS. 3, and 5–7, there may be valves 150, 152, 154, and 156 that separate each of the suppressant sources 120, 122, 124, and 126 from the remainder of the manifold. Such valves may serve to prevent back flow, that is, the flow of a suppressant from one suppressant source into another source. Back flow is a particular concern when some, but not all, of the suppressant sources discharge. Valves 150, 152, 154, and 156 may also serve to reduce dead space, by blocking off portions of the manifold that are not in use when some, but not all, of the suppressant sources discharge. Furthermore, such valves may also serve to lock off the suppressant sources, so as to prevent accidental discharge of suppressant.

A variety of valves, including but not limited to El-check valves, may be suitable for this application. However, this is exemplary only.

El-check valves and other suitable valves are well known, and are not described further herein.

In addition, there may also be valves 162, 164, and 166 that separate the individual suppressant sources 120, 122, 124, and 126 from one another. Such valves may also serve to prevent back flow. Valves 162, 164, and 166 may also serve to reduce dead space, by blocking off portions of the manifold that are not in use when some, but not all, of the suppressant sources discharge.

A variety of valves, including but not limited to swing check and check valves, may be suitable for this application. However, this is exemplary only.

Swing check and check valves and other suitable valves are well known, and are not described further herein.

Furthermore, it is noted that the use of such additional valves is exemplary only. Embodiments with other arrangements of such additional valves, or without additional valves at all, may be equally suitable.

Figure 1:
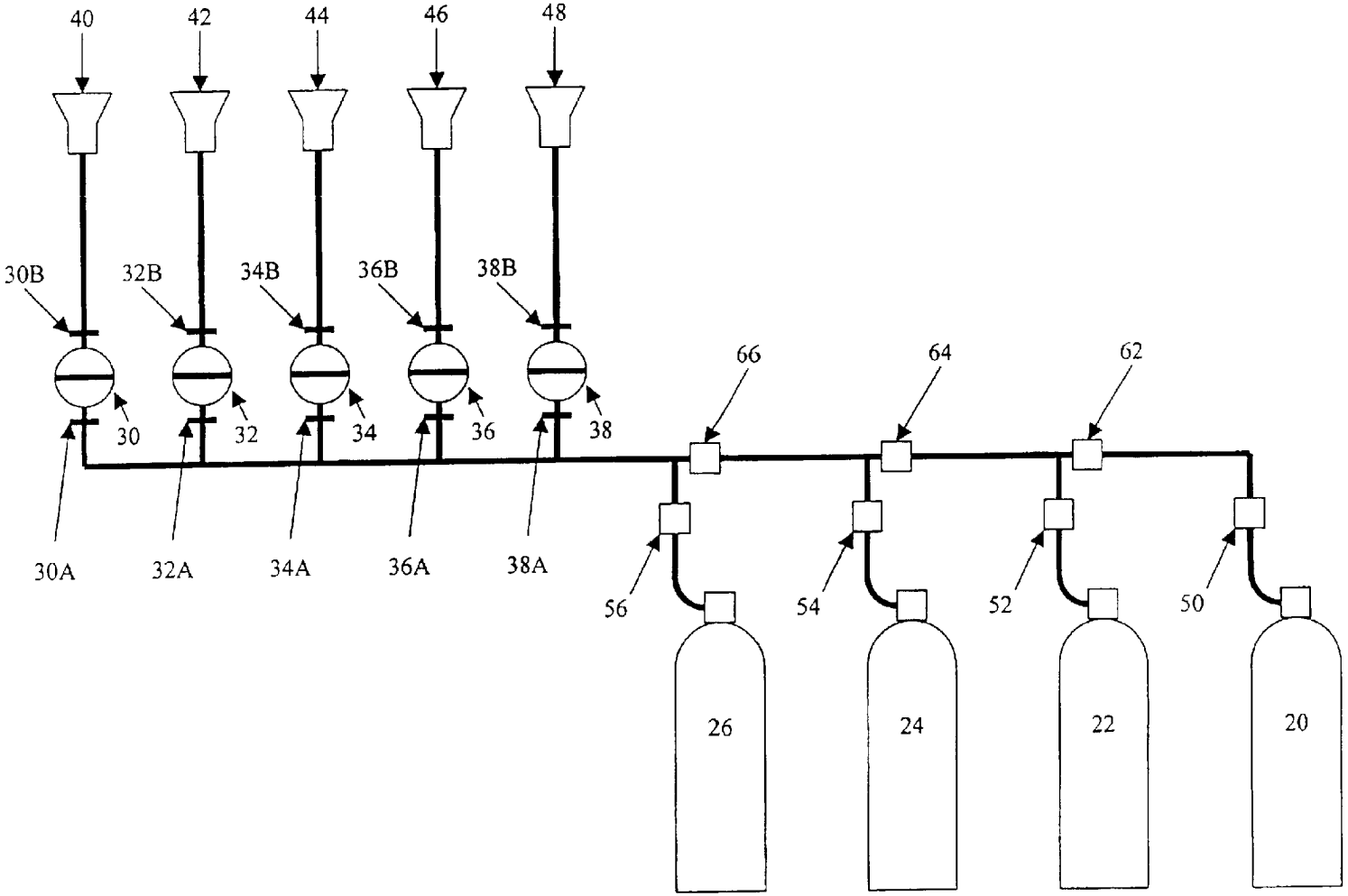
Figure 1 PRIOR ART
FIG. 1 is a schematic representation of a conventional suppressant distribution system, as known from the prior art, with all control valves in the closed position.
Figure 2:
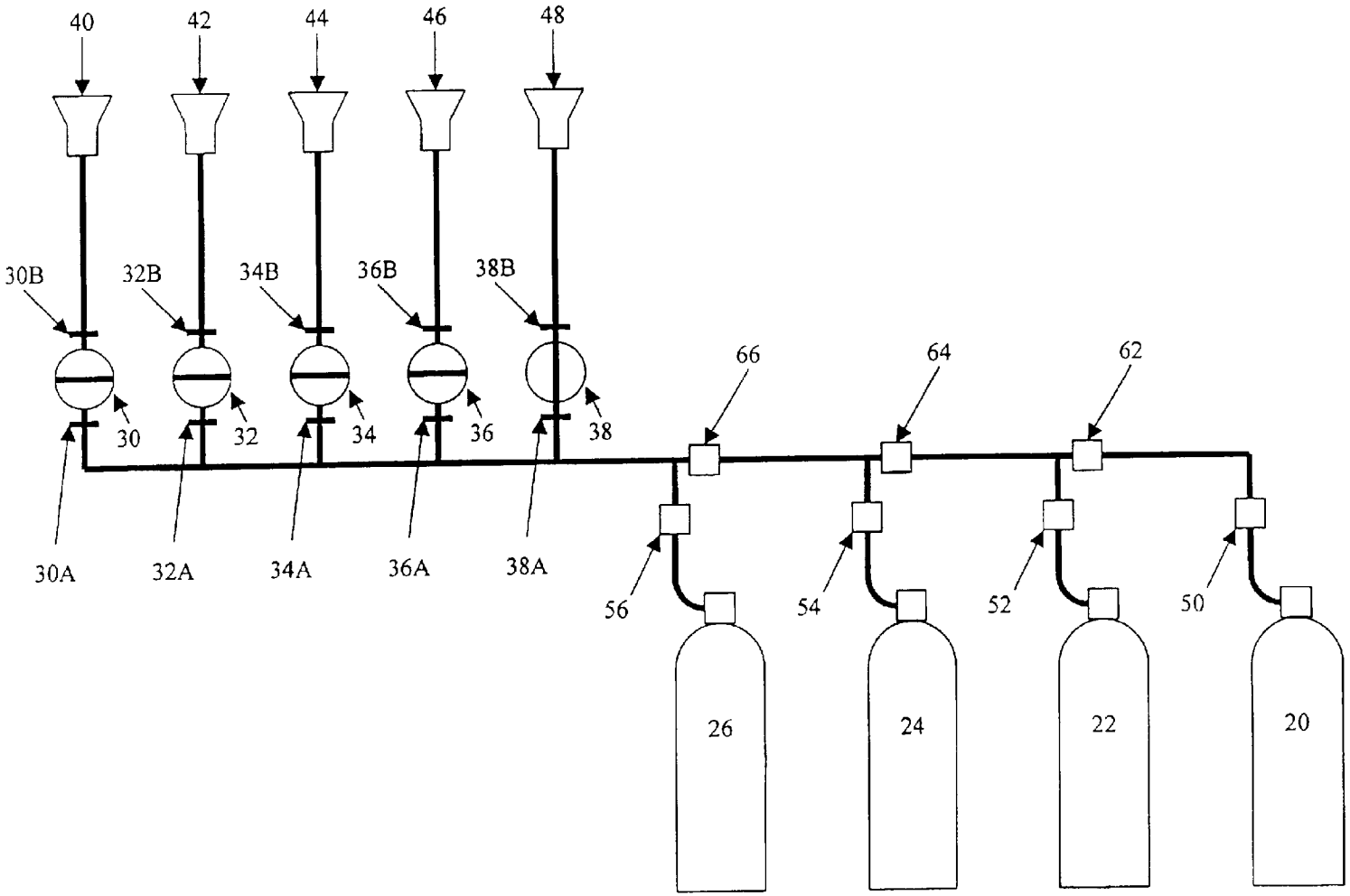
Figure 2 PRIOR ART
FIG. 2 is another view of the conventional suppressant distribution system shown in FIG. 1, with one of the control valves in the open position.

The use of valves 150, 152, 154, and 156 and valves 162, 164, and 166 is known per se. FIGS. 1 and 2 similarly show valves 50, 52, 54, and 56 and valves 62, 64, and 66 in prior art devices.

As was noted previously, each of the control valves 130, 132, 134, 136, and 138 is movable between at least first, second, and third positions, and may be movable to a fourth position as well. FIGS. 8A–D show a single valve, 130, in each of the first, second, third, and fourth positions, respectively.

Figure 8D:
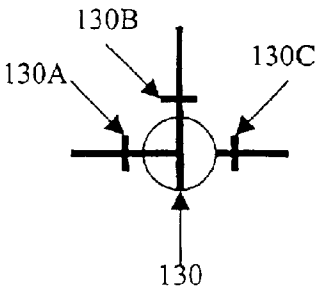
FIGS. 8A–D illustrate a schematic representation of a single control valve in accordance with the principles of the claimed invention, in each of four positions.
Figure 8C:
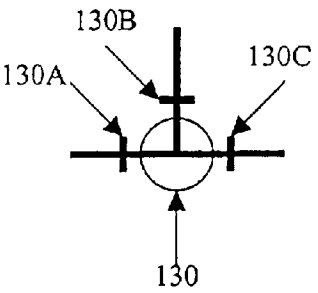
Figure 8B:
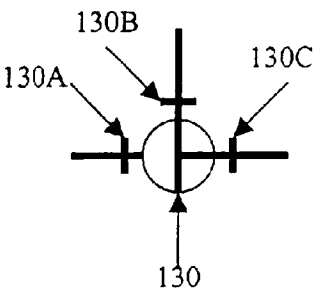
Figure 8A:
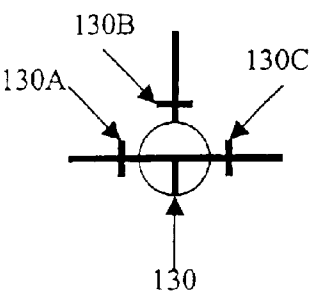

As shown in FIG. 8A, in the first position the first and third apertures 130A and 130C are in communication. Thus, suppressant may flow between the first and third apertures, to or from other elements in communication with those apertures. In the embodiment illustrated in FIG. 3, this would permit suppressant to flow through the valve 130 ("downstream"), but not to the distributor 140 in communication therewith.

As shown in FIG. 8B, in the second position the second and third apertures 130B and 130C are in communication. Thus, suppressant may flow between the second and third apertures. In the embodiment illustrated in FIG. 3, this would permit suppressant to flow to the distributor 140 in communication with the valve 130, but not through the valve 130.

As shown in FIG. 8C, in the third position the first, second, and third apertures 130A and 130C are in communication. Thus, suppressant may flow between the first, second, and third apertures. In the embodiment illustrated in FIG. 3, this would permit suppressant to flow through the valve 130, and to the distributor 140 in communication therewith.

As shown in FIG. 8D, in the first position the first and third apertures 130A and 130C are in communication. Thus, suppressant may flow between the first and third apertures, to or from other elements in communication with those apertures. In the embodiment illustrated in FIG. 3, this would not permit suppressant to flow either through the valve 130 or to the distributor 140 in communication therewith.

Thus, in particular with reference to FIG. 8D, depending on the particulars of a given embodiment in accordance with the principles of the claimed invention, communication between two apertures of a control valve does not necessarily imply a flow of suppressant therethrough.

FIG. 4 shows a schematic representation of control valves 130, 132, 134, 136, and 138 in various positions, and the results of each arrangement for the embodiment illustrated in FIG. 3.

Figure 4A:
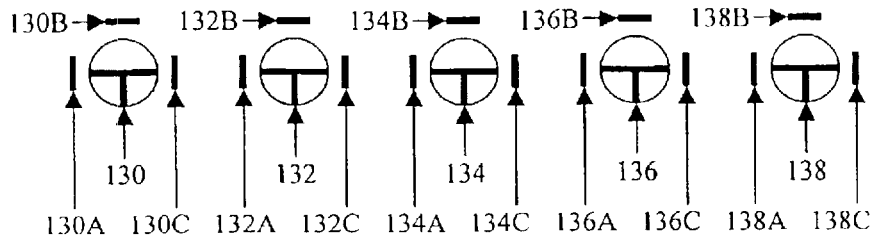
Figure 4A:
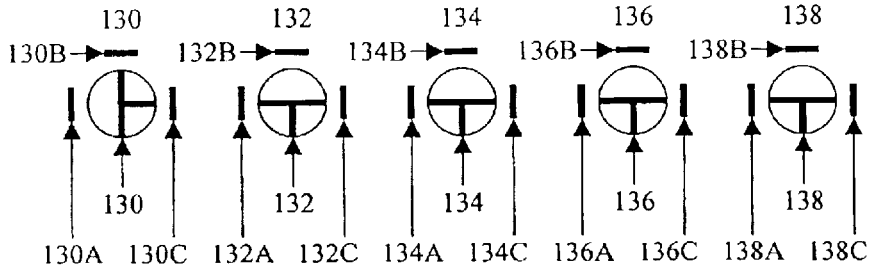
Figure 4A:
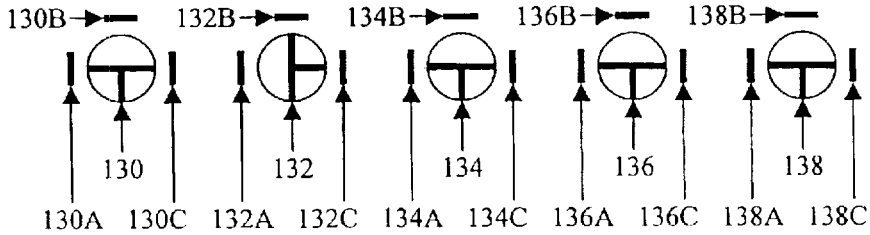
Figure 4A:
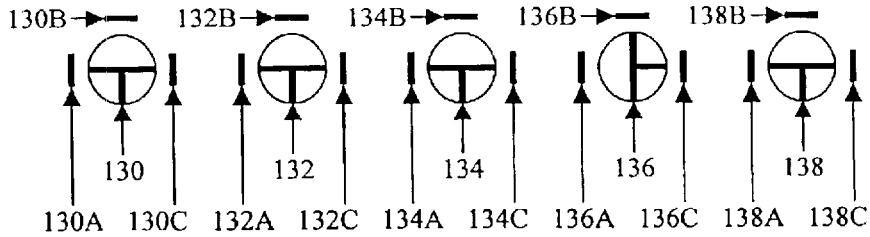
Figure 4A:
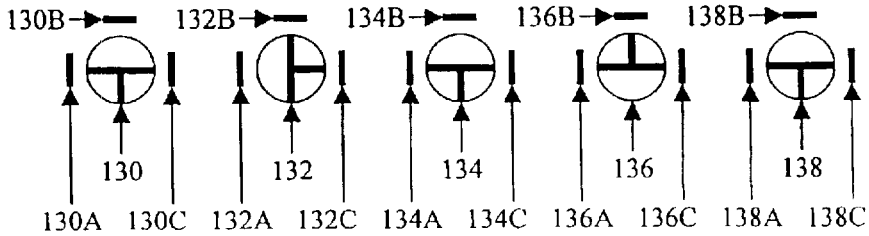
Figure 4A:
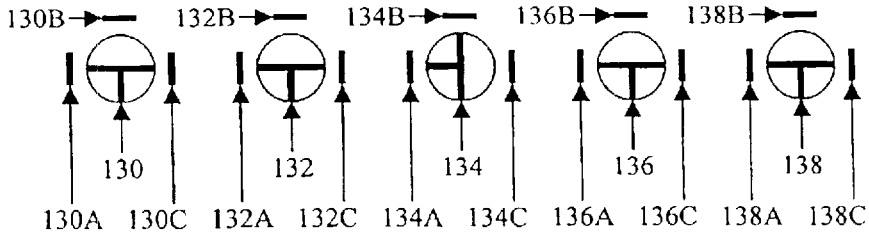

In FIG. 4A, all of the control valves 130, 132, 134, 136, and 138 are in the first position. Thus, in the embodiment of FIG. 3, they can pass suppressant therethrough, but cannot pass suppressant to their distributors 140, 142, 144, 146, and 148. Thus, with the valves 130, 132, 134, 136, and 138 in arrangement A, no suppressant is sent to any of the distributors.

It is noted that, in certain embodiments, even a when particular valve is in a position to pass suppressant therethrough to a particular aperture, suppressant reaching the valve may not actually go anywhere. For example, although as shown in FIG. 3 (and in FIG. 4A), although control valve 130 is in the first position, so that the first and third apertures 130A and 130C are in communication, there is nowhere for suppressant to go after passing through control valve 130. Not only the positions of the valve, but also the configuration of the apparatus 10 as a whole, influences the particular manner in which suppressant can be distributed.

In FIG. 4B, control valve 130 is in the second position, while control valves 132, 134, 136, and 138 are in the first position. Control valves 132, 134, 136, and 138 pass suppressant therethrough, but do not pass it to their distributors 142, 144, 146, and 148. However, control valve 130 still passes suppressant to distributor 140.

In FIG. 4C, control valve 132 is in the second position, while control valves 130, 134, 136, and 138 are in the first position. Control valves 134, 136, and 138 pass suppressant therethrough, but do not pass it to their distributors 144, 146, and 148. Control valve 132 passes suppressant to distributor 142. However, control valve 132 does not pass suppressant therethrough, so no suppressant reaches control valve 130. Thus, suppressant is delivered only to distributor 142, and there is no dead space, i.e. no space beyond valves 132 that is unnecessarily filled with unused suppressant.

FIG. 4D is similar to arrangements B and C, in that one control valve is in the second position, while the other control valves are in the first position. In arrangement D, control valve 136 is in the second position, while control valves 130, 132, 134, and 138 are in the first position. Control valve 138 passes suppressant therethrough, but does not pass it to distributor 148. Control valve 136 passes suppressant to distributor 146. However, control valve 136 does not pass suppressant therethrough, so no suppressant reaches control valves 130, 132, or 134. Thus, suppressant is delivered only to distributor 146, and there is no dead space beyond control valve 136.

It will be apparent to those of skill in the art that the arrangements shown in FIGS. 4B, 4C, and 4D may be generalized to other arrangements, wherein suppressant is to be delivered to any one of the distributors 140, 142, 144, 146, and 148.

In FIG. 4E, control valve 138 is in the third position, so as to pass suppressant both through itself and to distributor 148. Control valves 134 and 136 are in the first position, so as to pass suppressant therethrough. Thus, suppressant is passed to control valve 132. Control valve 132 is in the second position, passing suppressant to distributor 142. Thus, suppressant is delivered to both distributors 142 and 148, but not to any of the other distributors. Furthermore, there is no dead space beyond control valve 132.

It will be apparent to those of skill in the art that case E may be generalized to other arrangements, wherein suppressant is to be delivered to any two or more of the distributors 140, 142, 144, 146, and 148.

In arrangement F, control valve 134 is in the fourth position. Control valve 134 does not pass suppressant either to other control valves downstream, or to distributor 144. Thus, regardless of the position of control valves 130 and 132, suppressant will not reach distributors 130 and 132. Such a configuration may be useful during servicing, in cases wherein some portion of the system 110 is malfunctioning, or where it is desired to override the distribution of suppressant to some or all of the distributors 140, 142, 144, 146, and 148. However, the use of a fourth position is exemplary only, and embodiments wherein some or all of the control valves 130, 132, 134, 136, and 138 are not movable to a fourth position may be equally suitable.

Thus, as may be seen from FIG. 4, depending upon the positions of the valves 130, 132, 134, 136, and 138, suppressant may be sent to any one or more of the distributors 140, 142, 144, 146, and 148, without any dead space.

Furthermore, in arrangements wherein additional valves control which suppressant source or sources 120, 122, 124, and 126, any one or more of the suppressants may be directed to any one or more of the distributors, without any dead space.

A variety of valves may be suitable for use in an apparatus according to the principles of the claimed invention. One exemplary valve that is suitable for use as a control valve in the claimed invention is a so-called "T control valve", such as a three-way through T directional ball valve.

In a three-way through T directional ball valve, a ball with three passages that connect to form a T is rotatably set into a housing having at least three openings. As the ball is rotated, the three passages are brought into alignment with various of the openings in the housing. As a result, with the proper arrangement of ball passages and housing openings, three-way through T directional ball valves may be made to pass material straight through, or to divert it in different directions, or to do both simultaneously.

Three-way through T directional ball valves are known per se, and are not described further herein.

For purposes of clarity, the control valves 130, 132, 134, 136, and 138 valves in FIGS. 3–8 are illustrated as schematic renderings of three-way through T directional ball valves. As shown the three-way through T directional ball valves in FIGS. 3–5 are arranged with 90 degree separations between the three passages, and likewise with 90 degree separations between three openings in the housing. However, this is exemplary only, and other arrangements may be equally suitable.

Furthermore, the use of three-way through T directional ball valves is itself exemplary, and other valves may be equally suitable.

Although in the embodiments illustrated in FIGS. 3–5, all of the control valves are arranged in a single line, this is exemplary only. More complex arrangements are possible, including but not limited to multiple independent lines of valves, and interconnecting parallel lines or arrays of valves.

For example, FIG. 6 shows an embodiment of an apparatus 110 for fire suppression in accordance with the principles of the claimed invention with two a dual arrangement of control valves and distributors. In addition to the control valves 130, 132, 134, 136, and 138 and the distributors 140, 142, 144, 146, and 148 in the embodiments of FIGS. 3 and 5, the embodiment of FIG. 6 includes control valves 131, 133, 135, 137, and 139 and distributors 141, 143, 145, 147, and 149. The two groups of control valves and distributors are connected to the suppressant sources 120, 122, 124, and 126 in two lines, in an arrangement somewhat analogous to that of a parallel electrical circuit.

In the embodiment shown therein, the positions of control valves 131, 133, 135, 137, and 139 determine which of the distributors 141, 143, 145, 147, and 149 receives suppressant. Suppressant may be supplied to any one or more of the distributors.

In addition, the exemplary embodiment of FIG. 6 includes a further control valve 170 disposed between the two lines of control valves and the suppressant sources. This valve is similar in structure and function to control valves 130, 131, 132, 133, 134, 135, 136, 137, 138, and 139 that are in communication with the distributors. Like them, control valve 170 defines first, second, and third apertures 170A, 170B, and 170C therein, and is movable between at least three of first, second, third, and fourth positions.

In the first position, the first and third apertures of each valve are in communication with one another. In the second position, the second and third apertures of each valve are in communication with one another. In the third position, the first, second, and third apertures of each valve are in communication with one another. In the fourth position, the first and second apertures of each valve are in communication with one another.

In addition, as with the other control valves, in certain embodiments control valve 170 may be movable to all four of the positions described above.

However, rather than being in direct communication with a distributor, control valve 170 is in communication with the suppressant sources and with other control valves.

Thus, for the embodiment shown in FIG. 6, the control valve 170 can direct suppressant to control valves 130, 132, 134, 136, and 138, or to control valves 131, 133, 135, 137, and 139, or to both groups of control valves, or to none, depending on its position.

Which result is produced in which position depends at least in part upon the arrangement of control valve 170 in the particular embodiment under consideration. In the embodiment illustrated shown, with control valve 170 in the first position, the first and third apertures 170A and 170C are in communication, and no suppressant will flow from the suppressant sources to the other control valves.

In the second position, the second and third apertures 170A and 170C are communication, and suppressant may flow only to control valves 131, 133, 135, 137, and 139.

In the third position, the first, second, and third apertures are in communication, and suppressant may flow to both sets of control valves.

In the fourth position, the first and second apertures 170A and 170C are communication, and suppressant may flow only to control valves 130, 132, 134, 136, and 138.

Control valve 170 may serve functions similar to the other control valves. For example, it can limit dead space within the manifold, and can help to control which (if any) distributors receive suppressant.

It is emphasized, with reference to the example of further control valve 170, that the claimed invention is not limited to using control valves as described herein solely for direct control of distributors. Rather, as with control valve 170, similar control valves may be disposed at any T-junction in the apparatus 110.

It is noted that in the embodiment illustrated in FIG. 6, each of the control valves 130, 131, 132, 133, 134, 135, 136, 137, 138, and 139 also is located at a T-junction, where a line for carrying suppressant branches into three directions.

These further control valves, of which control valve 170 is an example, are not necessarily in direct communication with either distributors or suppressant sources. In the embodiment illustrated in FIG. 6, control valve 170 is in communication with suppressant sources 120, 122, 124, and 126. However, this is exemplary only. Indeed, in certain embodiments, it may be advantageous to include further control valves that are only in communication with other control valves.

However, the use of control valves at T-junctions within the apparatus 110 is exemplary only. Embodiments having one or more T-junctions that do not include control valves may be equally suitable.

Figure 7:
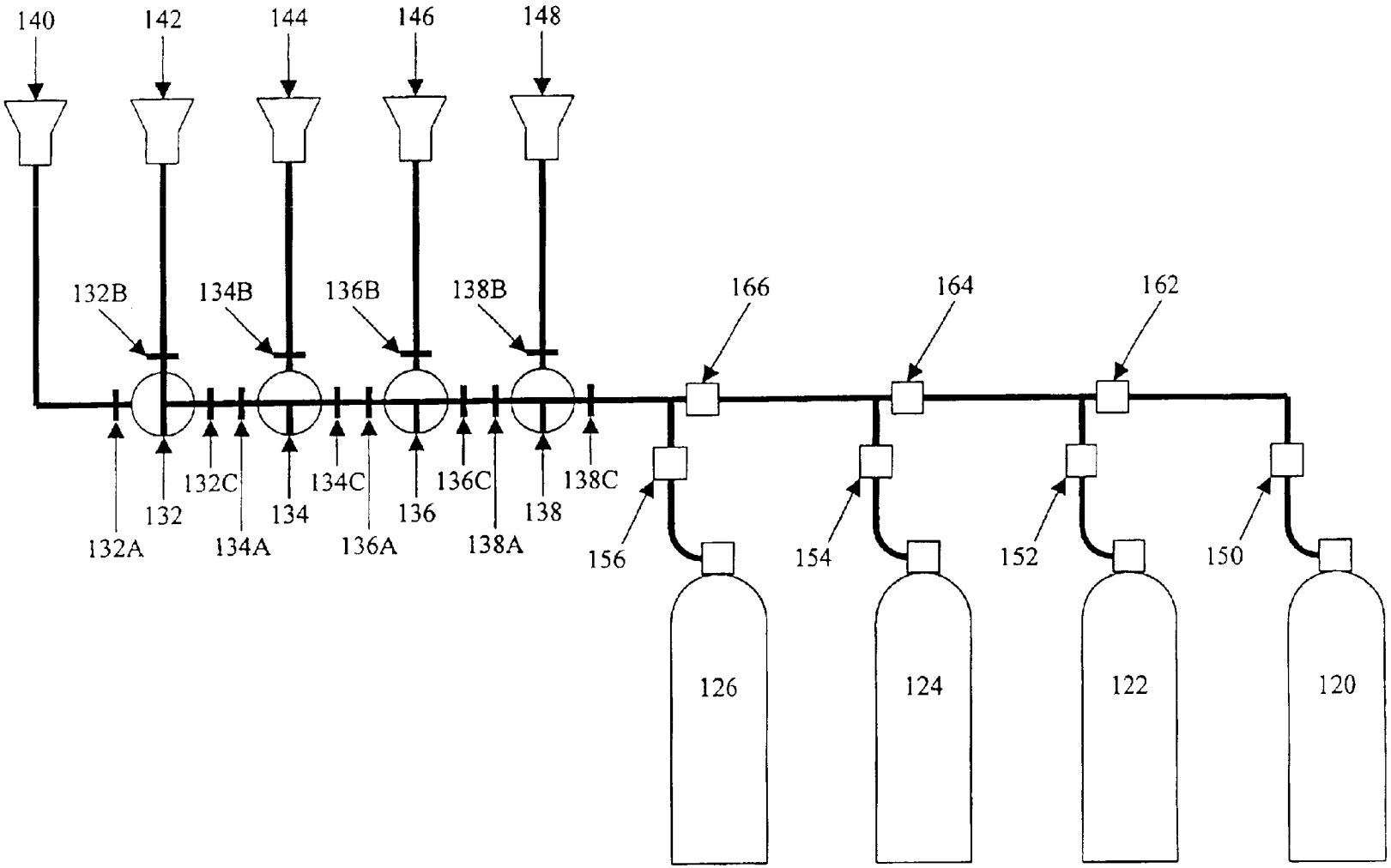
FIG. 7 is a schematic representation of yet another exemplary embodiment of a suppressant distribution system in accordance with the principles of the claimed invention, having a single control valve controlling more than one distributor.

It is noted that the lack of a control valve at a particular T-junction, in addition to being permissible, does not necessarily change the function of the apparatus. For example, FIG. 7 shows an exemplary embodiment of an apparatus in accordance with the principles of the claimed invention. The embodiment illustrated in FIG. 7 is similar to that in FIG. 3, except that control valve 130 is omitted.

However, the apparatus 110 of FIG. 7 retains the functionality of that shown in FIG. 3. Namely, it is still possible to distribute suppressant to any one or more of the distributors 140, 142, 144, 146, and 148. In particular, depending on the position of control valve 132, suppressant may be directed to either, both, or neither of distributors 140 and 142.

It will be appreciated by those of skill in the art that embodiments having more complex arrangements of control valves and distributors than those shown in FIGS. 6 and 7 may be equally suitable.

In particular, although FIG. 6 shows control valves and distributors arranged symmetrically, in a mirror image arrangement, this is exemplary only.

Likewise, as shown in FIG. 7, a single control valve may control the operation of more than one distributor. Conversely, embodiments wherein multiple control valves are used to control a single distributor may also be advantageous.

Furthermore, although in the embodiments shown and described, the suppressant sources are arranged together in a single line, this also is exemplary only. Embodiments wherein the suppressant sources are arranged differently, in particular where they are arranged in two or more separate groups or where they are distributed in a more complex arrangement than that of a single line, may be equally suitable.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A fire suppressing system, comprising:

at least one suppressant source;

at least two distributors in communication with said at least one suppressant source;

at least one control valve in communication with said at least one suppressant source, said at least one control valve being disposed at a connecting junction between said at least one suppressant source and said at least two distributors, such that said at least one control valve being in communication with said at least two distributors;

wherein said at least one control valve defines first, second, and third apertures therein, and is movable between at least three of first, second, third positions, and fourth positions, such that in said first position, said first and third apertures are in communication;

in said second position, said second and third apertures are in communication; and in said third position, said first, second and third apertures are in communication;

in said fourth position, said first and second apertures are in communication such that depending upon said positions of said control valves, said suppressing system directs suppressant from said at least one suppressant source to any combination of said distributors.

2. The fire suppressing system according to claim 1, further comprising:

a plurality of suppressant sources;

such that depending upon said positions of said control valves, said suppressing system directs suppressant from any of said suppressant sources to any combination of said distributors.

3. The fire suppressing system according to claim 1, wherein:

at least one of said control valves is movable between all of said first, second, third, and fourth positions.

4. The fire suppressing system according to claim 1, wherein:

said control valves are three-way through T directional ball valves.

5. The tire suppressing system according to claim 1, wherein:

said suppressant is a liquefied compressed gas chemical extinguishing agent.

6. The fire suppressing system according to claim 1, wherein:

said suppressant comprises one of the group consisting of HFC-227ea, HFC-23, $CO_2$, and $CF_3CF_2C(O)CF(CF_3)_2$.

7. The fire suppressing system according to claim 1, further comprising:

at least one further control valve disposed between and in communication with at least one of said control valves and at least one of said suppressant sources;

wherein said at least one further control valve defines first, second, third, and fourth positions, such that in said first position, said first and third apertures are in communication, in said second position, said second and third apertures are in communication;

in said third position, said first, second, and third apertures are in communication;

in said fourth position, said first and second apertures are in communication.

8. The fire suppressing system according to claim 1, further comprising:

at least one further control valve disposed at a T-junction in said system;

wherein said at least one further control valve defines first, second, third, and fourth positions, such that in said first position, said first and third apertures are in communication;

in said second position, said second and third apertures are in communication;

in said third position, said first, second, and third apertures are in communication;

in said fourth position, said first and second apertures are in communication.

9. A fire suppressing system, comprising:

at least one suppressant source;

at least two distributors in communication with said at least one suppressant source;

at least one control valve in communication with said at least one suppressant source, said at least one control valve being disposed at a connecting junction between said at least one suppressant source and said at least two distributors, such that said at least one control valve being in communication with said at least two distributors; and wherein said at least one control valve are movable between at least three of first, second, third, and fourth positions, such that in said first position, said at least one control valve passes suppressant therethrough, but does not pass suppressant to one of said distributors in direct communication therewith;

in said second position, said at least one control valves does not pass suppressant therethrough, but passes suppressant to one of said distributors in direct communication therewith;

in said third position, said at least one control valve passes suppressant therethrough, and passes suppressant to one of said distributors in direct communication therewith;

in said fourth position, said at least one control valve does not pass suppressant therethrough, and does not pass suppressant to one of said distributors in direct in communication therewith;

such that depending upon said positions of said control valves, said suppressing system directs suppressant from said at least one suppressant source to any combination of said distributors.

10. The fire suppressant system according to claim 9, further comprising:

a plurality of suppressant sources;

such that depending upon said positions of said control valves, said suppressing system directs suppressant from any of said suppressant sources to any combination of said distributors.

11. The fire suppressing system according to claim 9, wherein:

at least one of said control valves is movable between all of said first, second, third, and fourth positions.

12. The fire suppressing system according to claim 9, wherein:

said control valves are three-way through T directional ball valves.

13. The fire suppressing system according to claim 9, wherein:

said suppressant is a liquefied compressed gas chemical extinguishing agent.

14. The fire suppressing system according to claim 9, wherein:

said suppressant comprises one of the group consisting of HFC-227ea, HFC-23, $CO_2$, and $CF_3CF_2C(O)CF(CF_3)_2$.

15. A fire suppressant system comprising:

at least one suppressant source;

at least one distributor, each of said at least one distributor being in communication with at least one of said at least one suppressant source;

at least one control valve disposed at a T-junction disposed between said at least one suppressant source and said at least one distributor, wherein said at least one control valve defines first, second, and third apertures therein, and is movable between at least three of first, second, third, and fourth positions, such that in said first position, said first and third apertures are in communication;

in said second position, said second and third apertures are in communication;

in said third position, said first, second, and third apertures are in communication;

in said fourth position, said first and second apertures are in communication.

16. The fire suppressing system according to claim 15, wherein:

at least one of said control valves is movable between all of said first, second, third, and fourth positions.

17. The fire suppressing system according to claim 15, wherein:

said control valves are three-way through T directional ball valves.

18. The fire suppressing system according to claim 15, wherein:

said suppressant is a liquefied compressed gas chemical extinguishing agent.

19. The fire suppressing system according to claim 15, wherein:

said suppressant comprises one of the group consisting of HFC-227ea, HFC-23, $CO_2$, and $CF_3CF_2C(O)CF(CF_3)_2$.

20. A method for distributing fire suppressant, comprising the steps of arranging at least one control valve in communication with at least one suppressant source;

arranging said at least one control valve in communication with at least two distributors, said at least one control valve being disposed at a connecting junction between said at least one suppressant source and said at least two distributors;

wherein said at least one control valve is movable between at least three of first, second, third, and fourth positions, such that in said first position, said at least one control valve passes suppressant therethrough, but does not pass suppressant to one of said distributors in direct communication therewith;

in said second position, said at least one control valves does not pass suppressant therethrough, but passes suppressant to one of said distributors in direct communication therewith;

in said third position, said at least one control valve passes suppressant therethrough, and passes suppressant to one of said distributors in direct communication therewith;

in said fourth position, said at least one control valve does not pass suppressant therethrough, and does not pass suppressant to one of said distributors in direct communication therewith;

adjusting said positions of said control valves, so as to direct suppressant from said at least one suppressant source to any combination of said distributors.

* * * * *